US008561326B2

(12) United States Patent
Ruvang

(10) Patent No.: US 8,561,326 B2
(45) Date of Patent: Oct. 22, 2013

(54) PROTECTIVE WEAR ASSEMBLY FOR MATERIAL HANDLING APPARATUS

(75) Inventor: John A. Ruvang, Bartonville, TX (US)

(73) Assignee: Black Cat Blades Ltd., Edmonton, AB ( * ) Notice: Subject to any disclaimer, the term of this patent is extended or adjusted under 35 U.S.C. 154(b) by 0 days.

(21) Appl. No.: 13/557,323

(22) Filed: Jul. 25, 2012

(65) Prior Publication Data

US 2013/0052390 A1 Feb. 28, 2013

(51) Int. Cl.
*E02F 9/28* (2006.01)

(52) U.S. Cl.
USPC ..... 37/452

(58) Field of Classification Search
USPC ..... 37/446, 452–460, 444; 172/701.1–701.3; 403/370, 374, 320, 403/409.1
See application file for complete search history.

(56) References Cited

U.S. PATENT DOCUMENTS

| | | | | |
|---|---|---|---|---|
| 3,079,710 | A | 3/1963 | Larsen et al. | |
| 3,974,579 | A * | 8/1976 | Black et al. | 37/450 |
| 4,338,736 | A | 7/1982 | Radigan | |
| 5,088,214 | A | 2/1992 | Jones | |
| 5,337,495 | A * | 8/1994 | Pippins | 37/453 |
| 6,194,080 | B1 | 2/2001 | Stickling | |
| 8,281,505 | B2 * | 10/2012 | Karlsson | 37/452 |
| 2003/0167663 | A1 | 9/2003 | Champney | |
| 2007/0193075 | A1 | 8/2007 | Carpenter | |
| 2008/0000114 | A1 | 1/2008 | Bentley | |

FOREIGN PATENT DOCUMENTS

| | | | |
|---|---|---|---|
| WO | 93-16239 | A1 | 8/1993 |
| WO | 2004057117 | A1 | 7/2004 |
| WO | 2005095720 | A1 | 10/2005 |

OTHER PUBLICATIONS

Search Report issued Mar. 23, 2012 for international Application No. PCT/US11/49440, 6 pages.
Written Opinion issued Mar. 23, 2012 for international Application No. PCT/US11/49440, 4 pages.
Office Action issued Oct. 23, 2012, for U.S. Appl. No. 13/572,275, 20 pages.
Examination Report issued Apr. 16, 2013 for Australian Patent Application No. 2010229189, 4 pages.
Canadian Office Action issued Jan. 30, 2013 for Canadian Patent Application No. 2,755,824, 4 pages.
European Search Report issued Mar. 12, 2013 for European Patent Application No. 10756559.0, 7 pages.
Korean Office Action issued Mar. 5, 2013 for Korean Patent Application No. 10-2011-7023453, 4 pages.

* cited by examiner

*Primary Examiner* — Robert Pezzuto
(74) *Attorney, Agent, or Firm* — Smith IP Services, P.C.

(57) ABSTRACT

A wear assembly for use on a material handling apparatus can include a base having an attachment surface which attaches to the material handling apparatus and an engagement surface which is substantially parallel to the attachment surface, and a cover which protects the base from wear, the cover including another engagement surface which complementarily engages the base engagement surface. Another wear assembly can include a base having an attachment surface which attaches to the apparatus, and engagement surfaces which are inclined and not perpendicular relative to the attachment surface. The wear assembly can also include a cover with engagement surfaces which complementarily engage the base engagement surfaces. Yet another wear assembly can include a base having an attachment surface which attaches to the material handling apparatus, a cover which protects the base from wear, and an internally threaded nut received in a recess in the base.

22 Claims, 7 Drawing Sheets

PROTECTIVE WEAR ASSEMBLY FOR MATERIAL HANDLING APPARATUS

CROSS-REFERENCE TO RELATED APPLICATION

This application claims the benefit under 35 USC §119 of the filing date of International Application Serial No. PCT/US11/49440 filed 26 Aug. 2011. The entire disclosure of this prior application is incorporated herein by this reference.

BACKGROUND

This disclosure relates generally to equipment utilized and operations performed in conjunction with material handling apparatus and, in an embodiment described herein, more particularly provides an expendable protective wear assembly.

It is common practice to attach wear plates to excavation equipment, in order to reduce or at least mitigate wear on components of the excavation equipment. However, most such wear plates do not adequately prevent movement of the wear plates during use of the excavation equipment, and/or do not allow for convenient replacement of the wear plates when they are sufficiently worn.

Therefore, it will be appreciated that improvements are continually needed in the art of protecting material handling equipment from wear.

SUMMARY

In carrying out the principles of this disclosure, a protective wear assembly is provided which brings improvements to the art. One example is described below in which a wear assembly includes an expendable wear cover which engages a flat surface on a base attached to a material handling apparatus, for resisting loads normal to the base. Another example is described below in which engaged inclined faces on the cover and base resist lateral loads applied to the cover.

In one aspect, a wear assembly for use on a material handling apparatus is provided by this disclosure. In one example, the wear assembly can include a base having an attachment surface which attaches to the material handling apparatus and an engagement surface which is substantially parallel to the attachment surface, and a cover which protects the base and the material handling apparatus from wear, the cover including another engagement surface which complementarily engages the base engagement surface.

In another aspect, a wear assembly described below for use on a material handling apparatus can, in one example, include a base having an attachment surface which attaches to the material handling apparatus, and engagement surfaces which are inclined and not perpendicular relative to the attachment surface. The wear assembly can also include a cover which protects the base and the material handling apparatus from wear, the cover including engagement surfaces which complementarily engage the base engagement surfaces.

In yet another aspect, the disclosure below provides to the art a wear assembly for use on a material handling apparatus, with one example of the wear assembly including a base having an attachment surface which attaches to the material handling apparatus, a cover which protects the base and the material handling apparatus from wear, and an internally threaded nut received in a recess in the base.

These and other features, advantages and benefits will become apparent to one of ordinary skill in the art upon careful consideration of the detailed description of representative embodiments of the disclosure hereinbelow and the accompanying drawings, in which similar elements are indicated in the various figures using the same reference numbers.

DETAILED DESCRIPTION

Figure 1:
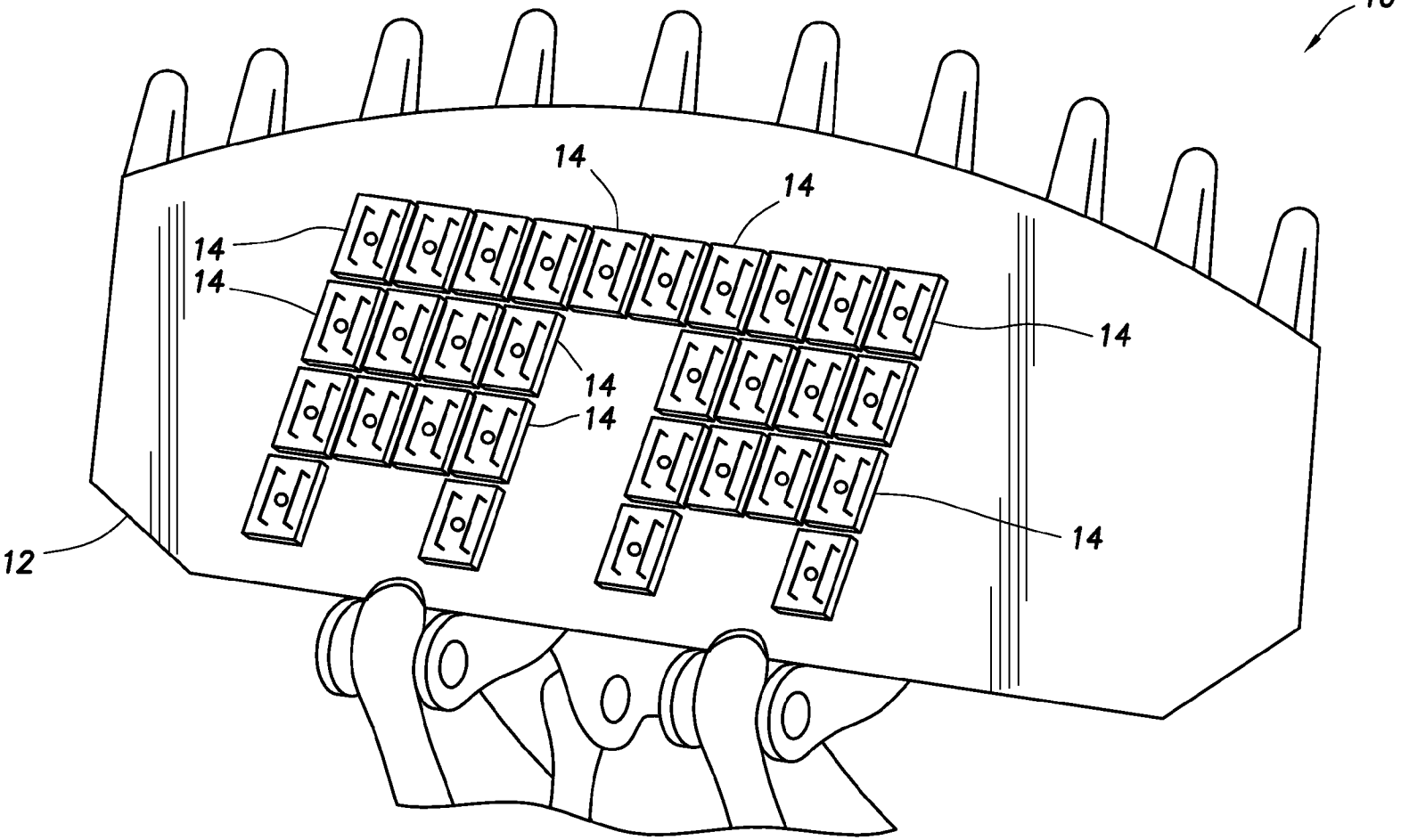
FIG. 1 is a representative perspective view of a material handling apparatus which can embody principles of this disclosure.

Representatively illustrated in FIG. 1 is a material handling apparatus 10 which can embody principles of this disclosure. In this example, the apparatus 10 is an excavator with a bucket 12 for excavating and transporting material. Protective wear assemblies 14 are attached to the bucket 12, in order to prevent or at least mitigate wear of the bucket.

The wear assemblies 14 are sacrificial and expendable, in that they are intended to wear, in place of the bucket 12 wearing. When one or more of the wear assemblies 14 are sufficiently worn down, they (or at least covers thereof) are replaced, so that wear surfaces exposed to the material (such as soil, rock, gravel, coal, bauxite, ore, other minerals, etc.) are periodically renewed, and the bucket 12 itself is protected from wear.

Figure 2:
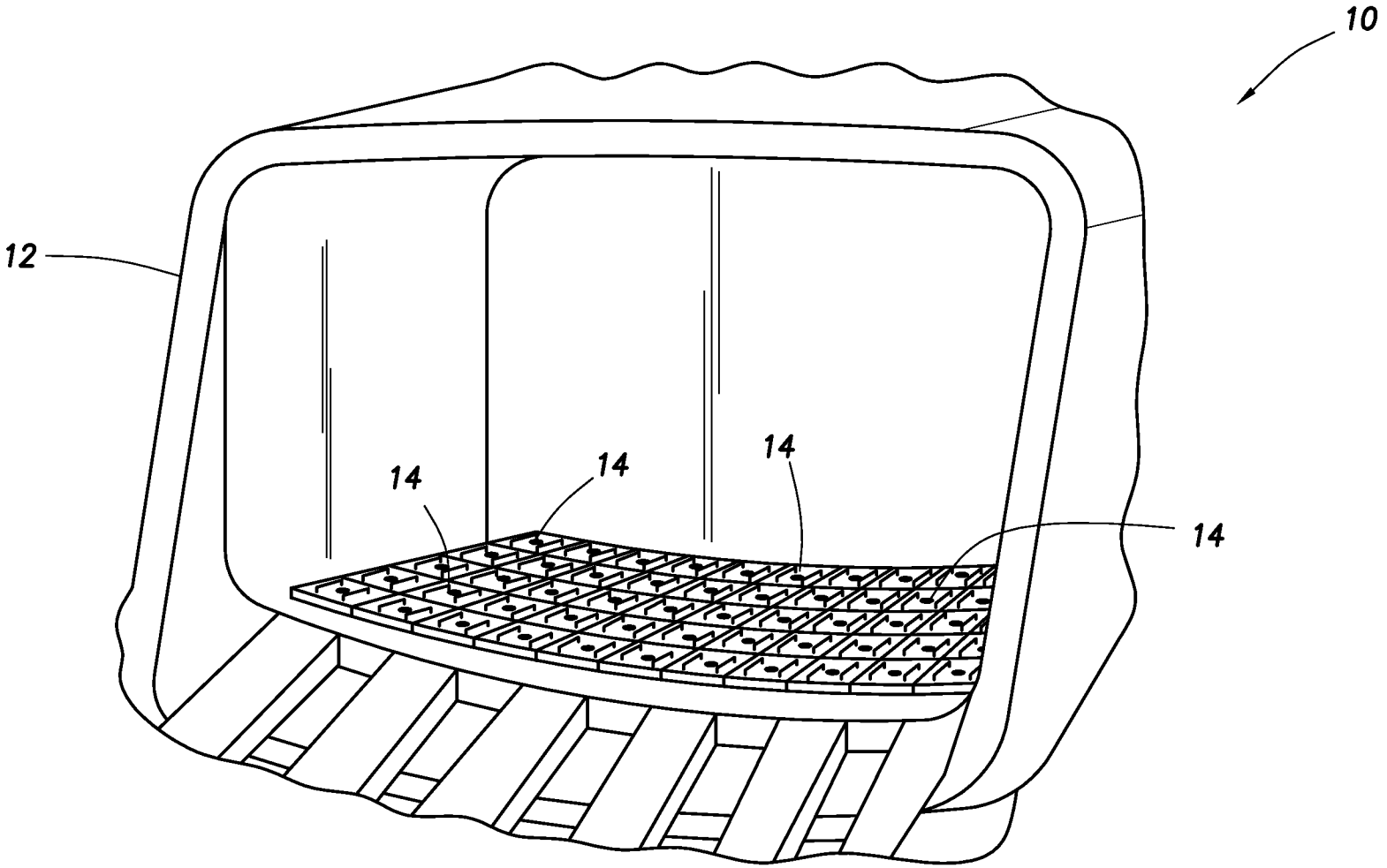
FIG. 2 is a representative perspective view of another material handling apparatus which can embody principles of this disclosure.

In FIG. 1, the wear assemblies 14 are attached to a lower external side of the bucket 12. In the example of FIG. 2, however, the wear assemblies 14 are attached to an inner side of the bucket 12. Thus, it will be appreciated that the wear assemblies 14 can be attached to any top, bottom, side, inner or outer (or other) side of a material handling apparatus, in keeping with the principles of this disclosure.

In other examples, the wear assemblies 14 may be used to protect material handling apparatuses other than excavators, and components other than buckets. For example, material crushers, conveyors, loaders, cable shovels, etc., and other types of material handling apparatus can incorporate the principles of this disclosure, and can use the wear assemblies 14 to protect surfaces thereon which would otherwise be subject to wear.

Figure 4:
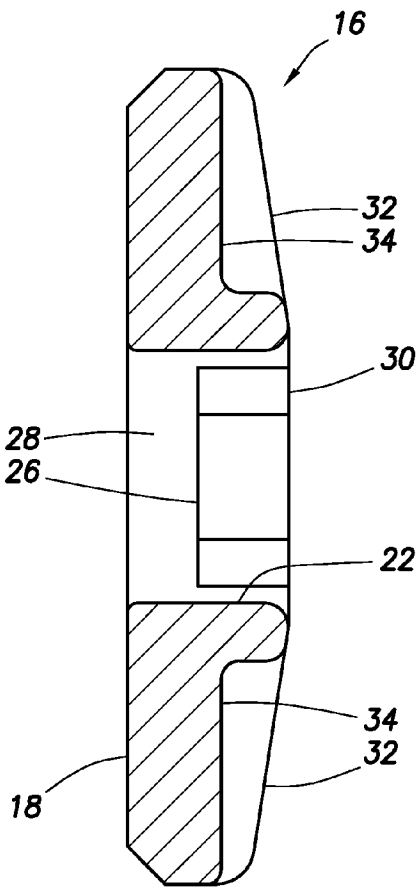
FIGS. 4 & 5 are representative cross-sectional views of the base, taken along lines 4-4 and 5-5, respectively, of FIG. 3.
Figure 3:
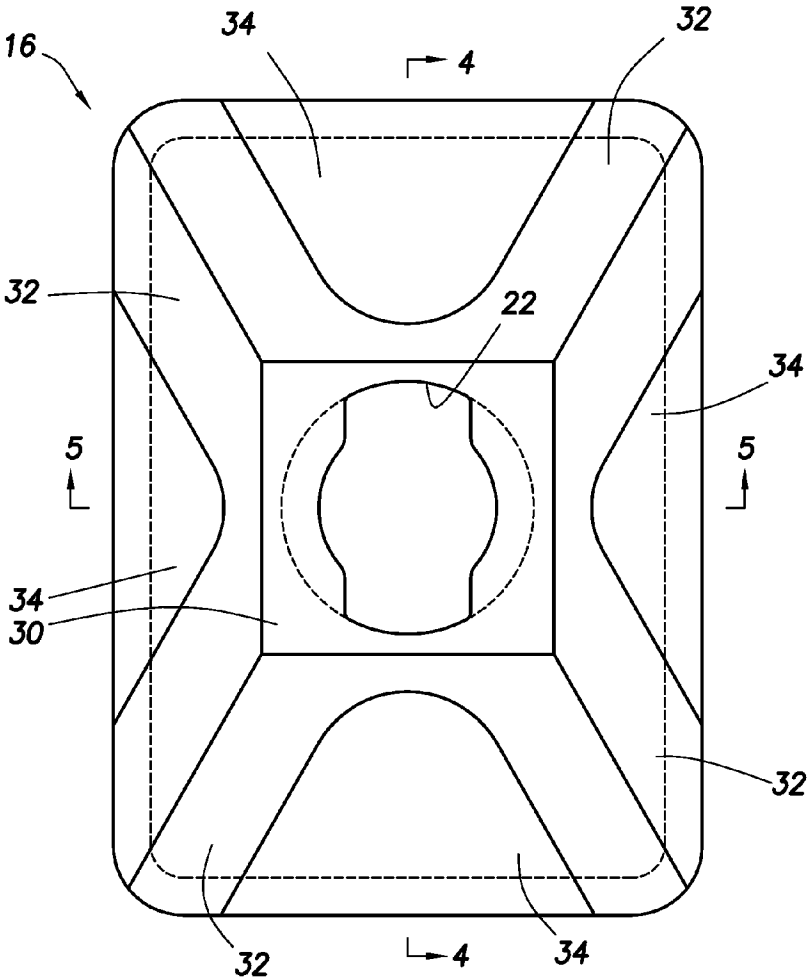
FIG. 3 is a representative top view of a base of a wear assembly which can embody principles of this disclosure.
Figure 5:
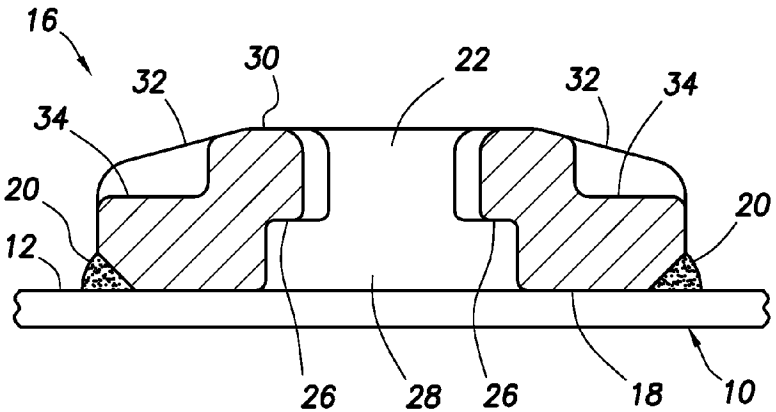

Referring additionally now to FIGS. 3-5, an example of a base 16 of the wear assembly 14 is representatively illustrated. Preferably, a generally planar attachment surface 18 on the the base 16 is permanently attached to the material handling apparatus 10 (for example, with welds 20, etc.), although in other examples the base could be semi-permanently or removably attached to the apparatus.

The base 16 includes a generally oblong opening 22 for receiving a nut 24 (see FIGS. 9-11) captively therein. The nut 24 is itself oblong, so that it can pass conveniently through the opening.

However, when the nut 24 is rotated ninety degrees after being inserted in the opening 22, shoulders 26 on either side of the opening prevent the nut from being removed from the base 16. Thus, the nut 24 can be releasably retained in a space or recess 28 below the shoulders 26.

In other examples, a separate nut 24 may not be used (for example, the base 16 could itself be internally threaded, etc.). In still further examples, external threads (such as, on a bolt, screw or threaded stud) may be used in the base 16, instead of internal threads.

Another generally planar surface 30 is formed on the base 16. The surface 30 is preferably parallel to the attachment surface 18 for reasons explained more fully below.

Inclined surfaces 32 slope downwardly from the surface 30 toward the surface 18. Note that the surface 30 is centrally positioned, in that it is positioned between opposing pairs of the surfaces 32. Recesses 34 are incorporated into the base 16 for weight reduction.

Figure 6:
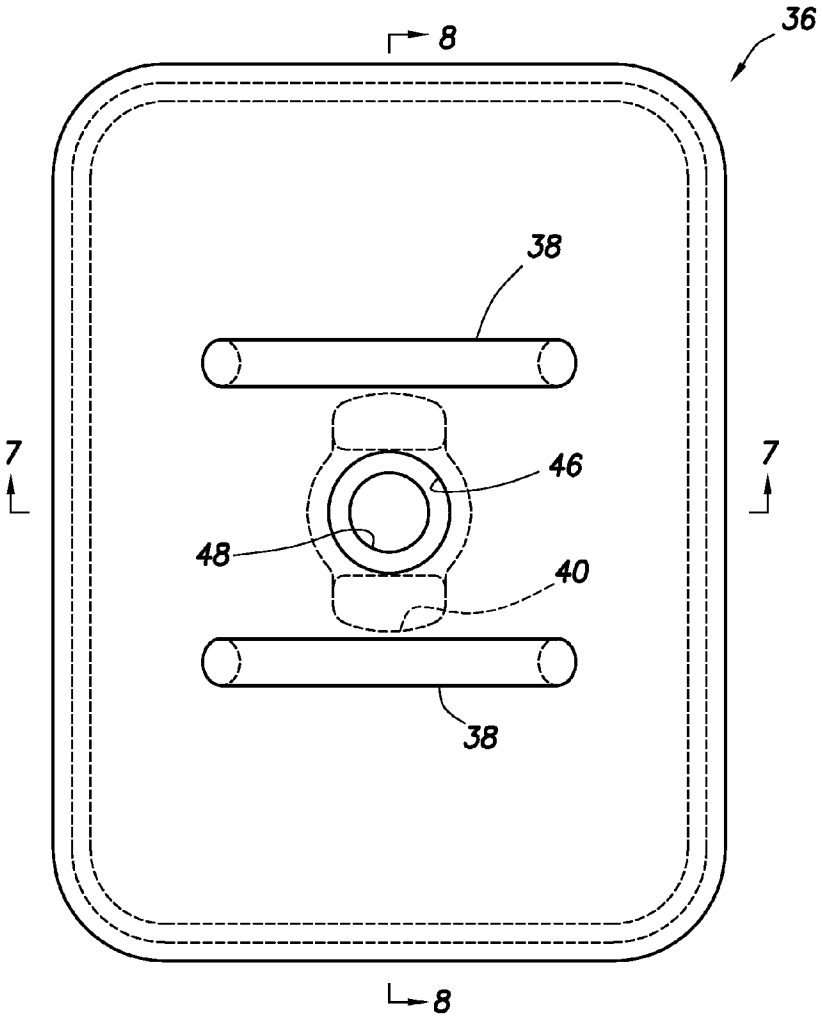
FIG. 6 is a representative top view of a cover of the wear assembly.
Figure 8:
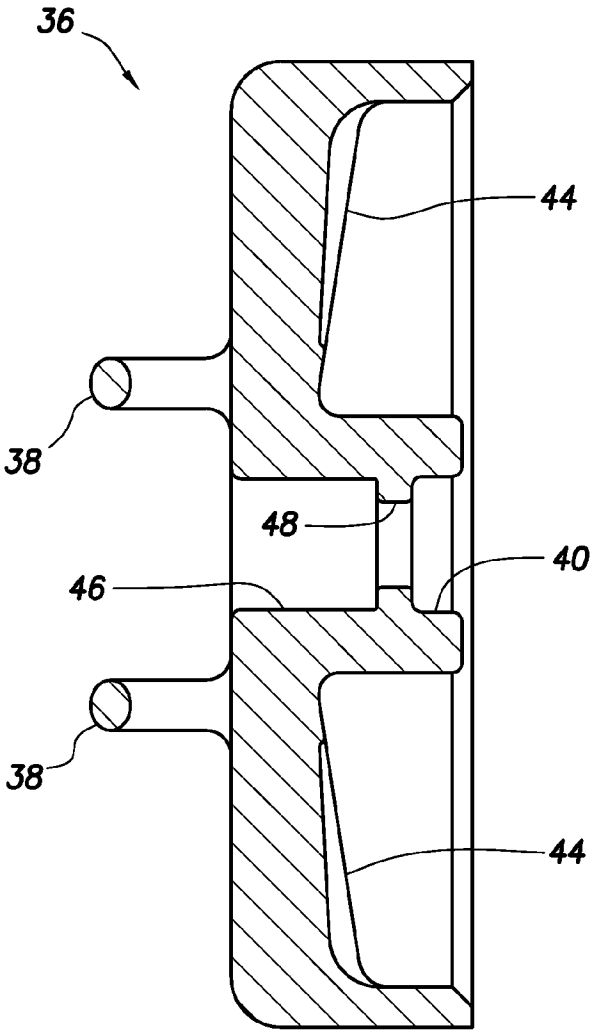
FIGS. 7 & 8 are representative cross-sectional views of the cover, taken along lines 7-7 and 8-8, respectively, of FIG. 3.
Figure 7:
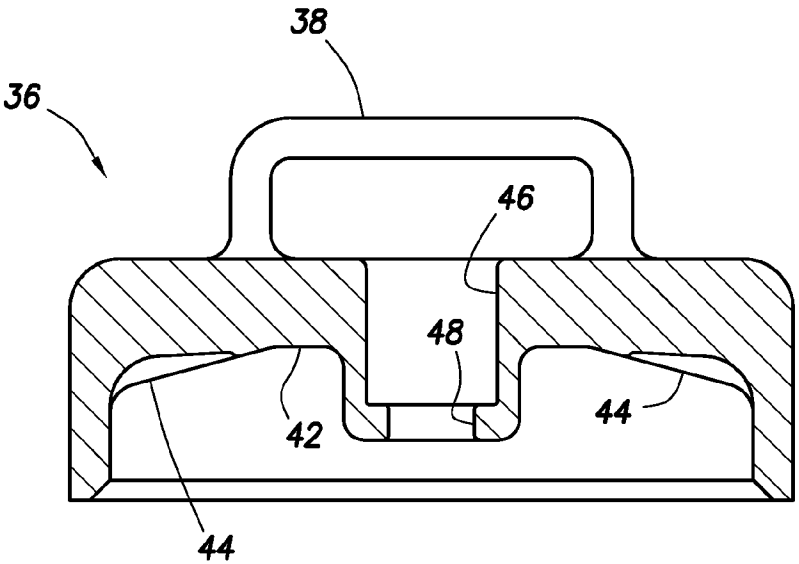

Referring additionally now to FIGS. 6-8, an example of a cover 36 for the wear assembly 14 is representatively illustrated. The cover 36 is designed to wear during operation of the apparatus 10, and then to be conveniently replaceable when sufficiently worn.

The cover 36 substantially envelops the base 16 (other than the surface 18 attached to the apparatus 10), and thereby protects the base from wear, while also protecting the apparatus 10 from wear. Handles 38 are provided on the cover 36 for convenient handling of the cover during installation and removal.

The cover 36 includes a recess 40 which is similar in some respects to the opening 22 in the base 16, in that the recess 40 is oblong for receiving the oblong nut 24 therein. The recess 40 is shaped in this manner, so that it can engage the nut 24 and thereby prevent rotation of the nut when the cover 36 is being installed or removed from the base 16.

The cover 36 includes a generally planar surface 42 therein, which in some examples can contact the surface 30 of the base 16 for resisting loads applied normal to the attachment surface 18. The cover 36 also includes inclined surfaces 44 which slope downwardly from the surface 42. In this manner, the surfaces 42, 44 of the cover 36 are complementarily shaped relative to the respective surfaces 30, 32 of the base 16.

Another recess 46 and an opening 48 are provided in the cover 36 to receive a fastener 50 (see FIGS. 9-11) therein. Preferably, a head 52 of the fastener 50 is retained in the recess 46, and a threaded portion of the fastener extends through the opening 48 into threaded engagement with the nut 24. However, other types of fasteners, and other arrangements of fastener components may be used in other examples, if desired.

Figure 9:
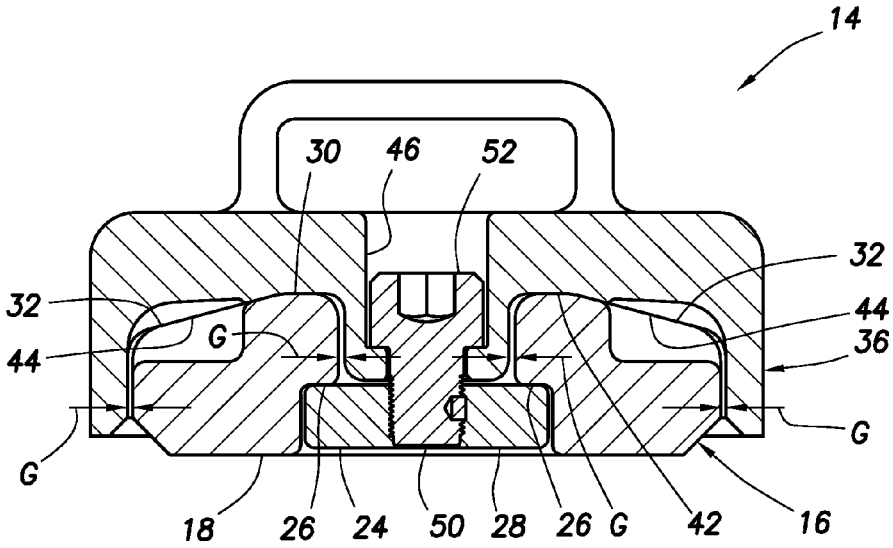
FIGS. 9 & 10 are representative cross-sectional views of the wear assembly.
Figure 10:
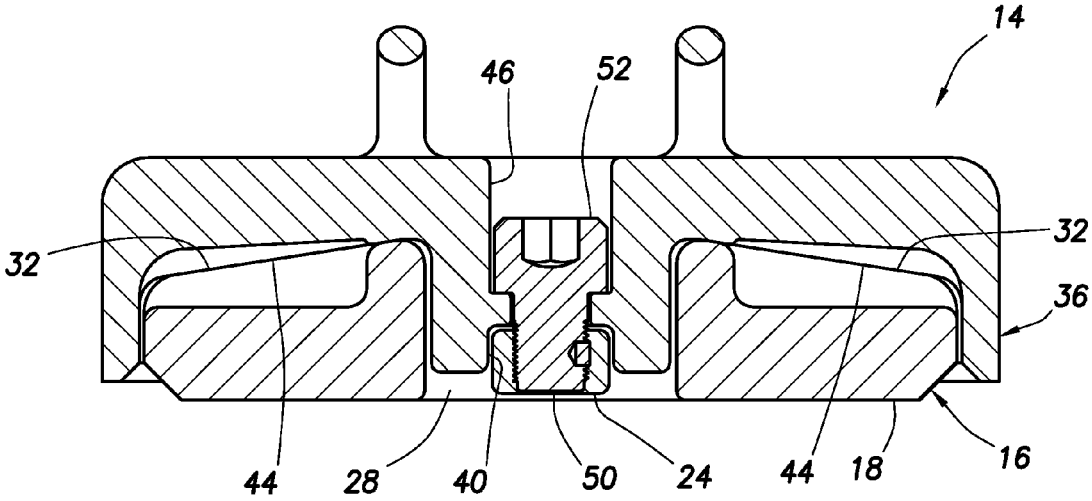

Referring additionally now to FIGS. 9 & 10, cross-sectional views of the assembled wear assembly 14 are representatively illustrated. In these views, the manner in which the shoulders 26 retain the nut 24 in the recess 28 in the base 16, the manner in which the recess 40 in the cover 36 prevents rotation of the nut while the fastener 50 is tightened or loosened, the manner in which the parallel surfaces 30, 40 on the base 16 and cover 36 contact each other and serve to resist loads applied normal to the attachment surface 18, and the manner in which the inclined surfaces 32, 44 on the base and cover contact each other and serve to resist loads applied laterally to the cover, can be clearly seen.

In addition, note that the engaged surfaces 32, 44 operate to center the cover 36 on the base 16 when the fastener 50 is tightened into the nut 24. In some examples, the nut 24 can have some resilience, so that upon tightening the fastener 50 therein, the nut applies a resilient biasing force to the shoulders 26, thereby maintaining contact between the respective surfaces 30, 42 and 32, 44 as loads are applied and released from the assembly 14.

Furthermore, note that lateral gaps G exist between the base 16 and the cover 36, so that lateral loads applied to the cover are resisted only by the contact between the surfaces 32, 44. However, in other examples, the lateral loads are not necessarily resisted only by contact between the surfaces 32, 44. For example, the gaps G could be nonexistent or negligible.

Figure 11:
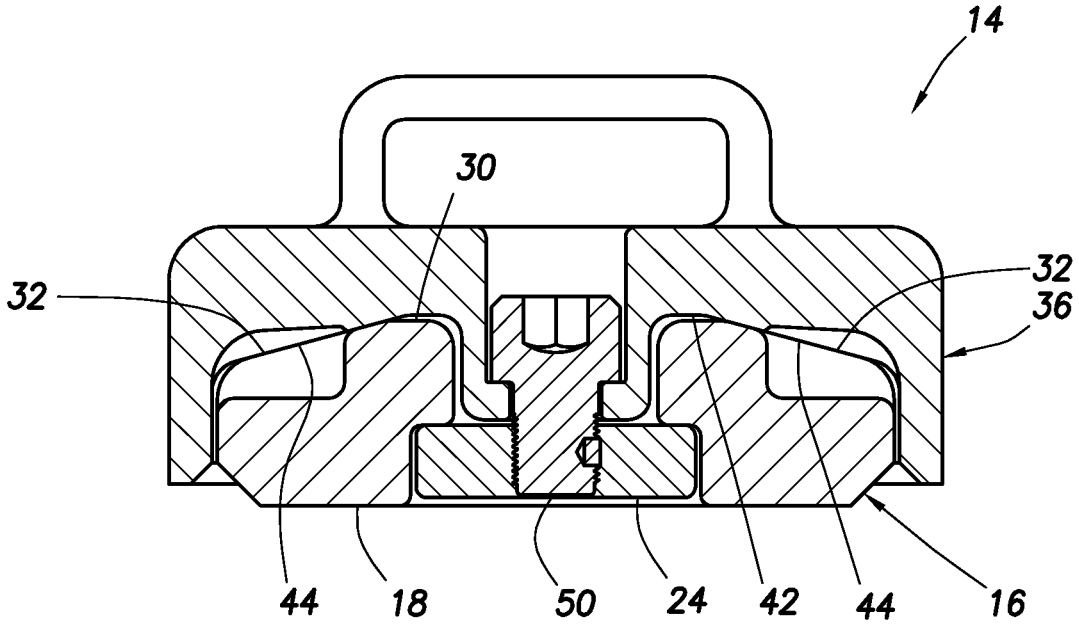
FIG. 11 is a representative cross-sectional view of another configuration of the wear assembly.

Referring additionally now to FIG. 11, another example of the wear assembly 14 is representatively illustrated. In this example, the planar surfaces 30, 42 do not contact each other when the cover 36 is attached to the base 16. Instead, there is a gap between the surfaces 30, 42.

Thus, the loads applied to the cover 36 which are normal to the attachment surface 18 are not resisted by contact between the surfaces 30, 42. Rather, such loads are resisted by the contact between the inclined surfaces 32, 44.

This arrangement preferably ensures that the surfaces 32, 44 remain in contact with each other throughout the useful life of the cover 36, with the engagement between the surfaces continuing to center the cover 36 on the base 16. One advantage to this example is that precise machining is not necessary to achieve simultaneous contact between the surfaces 30, 42 and the surfaces 32, 44.

It may now be fully appreciated that the above disclosure provides significant advancements to the art of protecting material handling apparatuses from wear. In examples described above, a cover 36 of the wear assembly 14 is conveniently replaceable by unthreading the fastener 50 from the nut 24, while the nut is retained in the base 16 and prevented from rotating by the recess 40. Engagement between the cover 36 and the base 16 effectively resists loads applied from various directions.

The above disclosure describes a wear assembly 14 for use on a material handling apparatus 10. In one example, the wear assembly 14 can include a base 16 having an attachment surface 18 which attaches to the material handling apparatus 10, and a first engagement surface 30 which is substantially parallel to the attachment surface 18. A cover 36 protects the base 16 and the material handling apparatus 10 from wear, the cover 36 including a second engagement surface 42 which complementarily engages the first engagement surface 30.

The base 16 can also include third engagement surfaces 32 which are inclined and not parallel relative to the attachment surface 18. The cover 36 can include fourth engagement surfaces 44 which complementarily engage the third engagement surfaces 32.

Engagement between the third and fourth engagement surfaces 32, 44 can prevent lateral displacement of the cover 36 relative to the base 16. The first engagement surface 30 may be positioned between the third engagement surfaces 32.

The wear assembly 14 may include an internally threaded nut 24 received in a first recess 28 in the base 16. The nut 24 may be oblong.

The nut 24 may be received in a second recess 40 in the cover 36, whereby the second recess 40 prevents rotation of the nut 24.

The wear assembly 14 may include an externally threaded fastener 50 having a head 52 received in a third recess 46 in the cover 36, with the fastener 50 being threaded into the nut 24.

Also described above is a wear assembly 14 which, in one example, can include a base 16 having an attachment surface 18 which attaches to the material handling apparatus 10, and first engagement surfaces 32 which are inclined and not perpendicular relative to the attachment surface 18. A cover 36 protects the base 16 and the material handling apparatus 10 from wear, with the cover 36 including second engagement surfaces 44 which complementarily engage the first engagement surfaces 32.

The above disclosure also describes a wear assembly 14 for use on a material handling apparatus 10, with the wear assembly 14 in one example including a base 16 having an attachment surface 18 which attaches to the material handling apparatus 10, a cover 36 which protects the base 16 from wear, and an internally threaded nut 24 received in a first recess 28 in the base 16.

The nut 24 may apply a resilient biasing force to the base 16. The nut 24 may flex resiliently between shoulders 26 on the base 16.

It is to be understood that the various embodiments of this disclosure described herein may be utilized in various orientations, such as inclined, inverted, horizontal, vertical, etc., and in various configurations, without departing from the principles of this disclosure. The embodiments are described merely as examples of useful applications of the principles of the disclosure, which is not limited to any specific details of these embodiments.

In the above description of the representative examples, directional terms (such as "above," "below," "upper," "lower," etc.) are used for convenience in referring to the accompanying drawings. However, it should be clearly understood that the scope of this disclosure is not limited to any particular directions described herein.

Of course, a person skilled in the art would, upon a careful consideration of the above description of representative embodiments of the disclosure, readily appreciate that many modifications, additions, substitutions, deletions, and other changes may be made to the specific embodiments, and such changes are contemplated by the principles of this disclosure. Accordingly, the foregoing detailed description is to be clearly understood as being given by way of illustration and example only, the spirit and scope of the invention being limited solely by the appended claims and their equivalents.

What is claimed is:

1. A wear assembly for use on a material handling apparatus, the wear assembly comprising:

a base having an attachment surface which attaches to the material handling apparatus, and a first engagement surface which is substantially parallel to the attachment surface;

a cover which protects the base from wear, the cover including a second engagement surface which complementarily engages the first engagement surface; and an internally threaded nut received in a first recess in the base, wherein shoulders on the first recess prevent the nut from being removed from the base when the nut is rotated ninety degrees after being inserted in the first recess.

2. The wear assembly of claim 1, wherein the nut is oblong.

3. The wear assembly of claim 1, wherein the nut is further received in a second recess in the cover, whereby the second recess prevents rotation of the nut.

4. The wear assembly of claim 1, further comprising an externally threaded fastener having a head received in a third recess in the cover, and the fastener being threaded into the nut.

5. The wear assembly of claim 1, wherein the nut applies a resilient biasing force to the base.

6. The wear assembly of claim 1, wherein the nut flexes resiliently between shoulders on the base.

7. A wear assembly for use on a material handling apparatus, the wear assembly comprising:

a base having an attachment surface which attaches to the material handling apparatus, and first engagement surfaces which are inclined and not perpendicular relative to the attachment surface;

a cover which protects the base from wear, the cover including second engagement surfaces which complementarily engage the first engagement surfaces; and an internally threaded nut received in a first recess in the base.

8. The wear assembly of claim 7, wherein the nut is oblong.

9. The wear assembly of claim 7, wherein the nut is further received in a second recess in the cover, whereby the second recess prevents rotation of the nut.

10. The wear assembly of claim 7, further comprising an externally threaded fastener having a head received in a third recess in the cover, and the fastener being threaded into the nut.

11. The wear assembly of claim 7, wherein the nut applies a resilient biasing force to the base.

12. The wear assembly of claim 7, wherein the nut flexes resiliently between shoulders on the base.

13. A wear assembly for use on a material handling apparatus, the wear assembly comprising:

a base having an attachment surface which attaches to the material handling apparatus;

a cover which protects the base from wear; and an internally threaded nut received in a first recess in the base and in a second recess in the cover.

14. The wear assembly of claim 13, wherein the nut is oblong.

15. The wear assembly of claim 13, wherein the second recess prevents rotation of the nut.

16. The wear assembly of claim 13, further comprising an externally threaded fastener having a head received in a third recess in the cover, and the fastener being threaded into the nut.

17. The wear assembly of claim 13, wherein the base further includes a first engagement surface which is substantially parallel to the attachment surface, and wherein the cover includes a second engagement surface which complementarily engages the first engagement surface.

18. The wear assembly of claim 13, wherein the nut applies a resilient biasing force to the base.

19. The wear assembly of claim 13, wherein the nut flexes resiliently between shoulders on the base.

20. A wear assembly for use on a material handling apparatus, the wear assembly comprising:

a base including an attachment surface which attaches to the material handling apparatus, a first engagement surface which is substantially parallel to the attachment surface, and third engagement surfaces which are inclined and not parallel relative to the attachment surface;

a cover which protects the base from wear, the cover including a second engagement surface which complementarily engages the first engagement surface, and fourth engagement surfaces which complementarily engage the third engagement surfaces; and an internally threaded nut received in a first recess in the base.

21. The wear assembly of claim 20, wherein engagement between the third and fourth engagement surfaces prevents lateral displacement of the cover relative to the base.

22. The wear assembly of claim 20, wherein the first engagement surface is positioned between the third engagement surfaces.

* * * * *

UNITED STATES PATENT AND TRADEMARK OFFICE

CERTIFICATE OF CORRECTION

PATENT NO. : 8,561,326 B2
APPLICATION NO. : 13/557323
DATED : October 22, 2013
INVENTOR(S) : John A. Ruvang It is certified that error appears in the above-identified patent and that said Letters Patent is hereby corrected as shown below:

Title page, insert item 30, "Foreign Application Priority Data"
-- 26 August 2011 (WO) ..... PCT/US11/49440 --.

Signed and Sealed this
Eleventh Day of February, 2014

Michelle K. Lee

Michelle K. Lee
*Deputy Director of the United States Patent and Trademark Office*